US006211767B1

(12) United States Patent
Jitaru

(10) Patent No.: US 6,211,767 B1
(45) Date of Patent: Apr. 3, 2001

(54) HIGH POWER PLANAR TRANSFORMER

(75) Inventor: Ionel Jitaru, Tucson, AZ (US)

(73) Assignee: Rompower Inc., Tucson, AZ (US)

( * ) Notice: Subject to any disclaimer, the term of this patent is extended or adjusted under 35 U.S.C. 154(b) by 0 days.

(21) Appl. No.: 09/316,924

(22) Filed: May 21, 1999

(51) Int. Cl.[7] ..... H01F 5/00; H01F 27/28

(52) U.S. Cl. ..... 336/200; 336/223; 336/232; 336/61

(58) Field of Search ..... 336/65, 61, 232, 336/223, 200, 192

(56) References Cited

U.S. PATENT DOCUMENTS

| | | | | |
|---|---|---|---|---|
| 4,692,604 | * | 9/1987 | Billings | 235/493 |
| 4,873,757 | * | 10/1989 | Williams | 29/602.1 |
| 5,161,098 | * | 11/1992 | Balakrishnan | 363/144 |
| 5,469,124 | * | 11/1995 | O'Donnell et al. | 336/61 |
| 5,760,671 | * | 6/1998 | Lahr et al. | 336/200 |
| 5,889,660 | * | 3/1999 | Taranowski et al. | 363/19 |
| 5,929,733 | * | 7/1999 | Anzawa et al. | 336/61 |

FOREIGN PATENT DOCUMENTS

| | | | | |
|---|---|---|---|---|
| 6-325952A | * | 11/1994 | (JP) | 336/200 |

* cited by examiner

*Primary Examiner*—Anh Mai

(57) ABSTRACT

A Low-to-High-Power, high reliability, high efficiency, small size transformer for power supply/DC—DC converter applications, using an inner layer winding constructed in a multilayers PCB and perfectly insulated with respect to the secondary, each layer having one ore more loops, interconnected to other layer by vias and contacted with simple pads, or any other contact type, including special connectors inserted in the PCB. The secondary is a special cooper strip designed as one or more one-turn strip, with pins designed for mechanical attachment and electrical contact. All the secondary strips on one side of the PCB, are perfectly symmetrical to the ones on the other side, so that they are interchangeable, and can be mounted on either side of the PCB. The secondary may be contacted directly to the strips, or with any other type of power connector inserted in the PCB. The magnetics are either E+I type, or I type, and the PCB has dedicated rectangular slots to accommodate the magnetics, and also special metalized holes to receive the secondary pins.

23 Claims, 13 Drawing Sheets

HIGH POWER PLANAR TRANSFORMER

BACKGROUND OF THE INVENTION

1. Field of the Invention

The present invention relates to the power transformer and more particularly to planar transformers field and power transformer structures, which involves the power transformer and different magnetic elements.

2. Description of the Related Art

In order to comply with the height requirements for power transformers the conventional barrel transformer have been replaced by planar structures. The planar structures consists in staking up layers composed by dielectric sheet and copper spirals interconnected through pins penetrating through holes in the dielectric sheets. In application wherein compliance with safety agencies is required which demands that a high voltage level has to be sustain in between primary winding and secondary winding a bobbin 37*a* and 37*b* may be employed as depicted in FIG. 3. In between he the dialectic layers such as 31*a*, there are spiral of copper material interconnected through interconnection holes such as 150, and interconnection pins. This method is labor intensive, requires a special bobbin and interconnection pins which are mechanical unreliable.

Another methodology is locating the winding within a multilayers PCB. Each layer of the multilayer PCB contains one or more spiral turns, which are interconnected using, metalized via. This method of construction is simple and reliable. It does not address the high power requirements. In order to process high current the copper thickness has to be high or the number of layers have to increased. Both solutions are very costly. The concept presented in this invention is combining the multilayer PCB construction for one of the transformer winding which process low current, with copper strips attached to the multilayer PCB using metalized holes for positioning and interconnection. The metalized via for positioning allow the use of soldering attachment. The multilayer PCB wherein the low current winding implemented offers the mechanical support for the secondary copper strips and the required insulation between the primary and secondary. Power connector may be further attached to the multilayer PCB for a better interface to the rest of the circuit. Another advantage of this technology is the fact that additional inductive elements can be implemented on the same multilayer PCB. Another advantage is the fact that multiple magnetic cores can be used on the same multilayer structure wherein the primary winding is embedded. These multiple transformer elements can have the primary in series or in parallel to ensure a uniform utilization of all the magnetic cores. Additional pads can be placed on the multilayer PCB to accommodate surface mounted components. Some of the layers of the multilayer PCB can be utilized for different function such as shielding or noise cancellation. In some of the embodiments of the invention the secondary winding can be also implemented in multilayer PCB technology. In this way we can have multiple turns for the secondary.

SUMMARY OF THE INVENTION

The main object of this invention is to provide a very versatile, modular, easy to manufacture, compact, low cost transformer, for all levels of power—low, medium, and high—applications The present invention is a special transformer, which can be used in multiple applications, ranging from low power to high power supplies, converts etc. It features a low cost, modularity and versatility, easy manufacturing, small size, high performance and reliability. Its primary is built into the inner layers of a PCB, and may have multiple configurations, according to different number of turns, for different voltage and current ratios. The "inside the PCB" configuration, offers superior separation and insulation, thus the small dimensions and the increased reliability of the device. The turns on each layer make contact with the ones on the next layer, using vias. According to the desired voltage ratio, the user may use the appropriate PCB/primary package, with the number of turns required by the specific application. The primary may be contacted with simple cooper pads on the top and bottom side of the PCB, or with separate, special connectors. The PCB also has a central rectangular slot to accommodate the middle part of the magnetic core and holes for attachment pins, vias, and connectors. The insulation between the primary winding and the core and the secondary winding can be made in several ways. One way is to locate all the primary winding inside of the multilayers PCB and the interconnection vias located to the required distance from the core and the secondary winding, in order to comply with the safety agency. The thickness of the dielectric between magnetic core and the primary winding has to be chosen also for compliance with the safety agencies. Another method is to bury the primary winding and the interconnection via in between two layers of dielectric. The thickness of the dielectric is chosen for compliance with the safety agency.

The secondary is a separate set of copper strips, also configurable according to the application. It may have different widths, thickness, and number of turns. The user will pick the one, which is appropriate for his needs. The secondary strip is attached to the PCB using bent pins, which have either only a mechanical, or mechano-electrical function, and which insure a precise positioning guaranteeing the safe distance to the primary and primary vias. Each turn has two lateral pins on one end, and four pins, two and two in offset positions, on the other end, in the middle of the side of the PCB. Also close to the middle of the strip, there is an additional pin, in a sideways position, to mechanically keep that part of the strip fastened to the PCB. The middle pins will keep the secondary strip attached to the PCB, and at the same time will transport the current to the strip on the other side of the PCB, that is, to the other half of the secondary. The secondary loop on the other side is an identical copper trip, just flipped 180 degrees, and inserted in the free PCB holes. This design has the advantage of cutting costs of manufacturing two different strips. This strip will use the correspondent respective pins receive the current and will transport it to the other end, thus, creating a 2,4 or more turns secondary. For more than two turn, for example four, the secondary uses an insulator sheet between the first two turns, then the PCB acts as an insulator between the second and the third, then another insulator sheet between the third and the fourth turn. The connection of the first turn strip to the second turn strip is made with special bent fins and holder slots; also soldering will be applied to the fins area, to mechanically and electrically strengthen the area. The connection between the second and the third turn is done as for the two turns secondary, that is by the pad area and pins. the connection between the third and the fourth strip is again done by bent-over pins. A small notch in the second turn strip will permit the middle attachment pin to run into the PCB without shortening the first two turns. The same for the notch in the third-turn strip and the attachment pin of the fourth turn. The strips on the two sides of the PCB are symmetrical, each of them may be mounted on either side. They may have one or more turns. they may use separate connectors, or just holes for connection purposes. The magnetics may be the E+I type, or just the E+E type, and will use a rectangular slot in the PCB for mounting.

Another embodiment of the present invention uses a thin, double-sided PCB's for each two turns of the secondary. Each secondary PCB, has a copper turn on each side, holes to receive the connector ends, and vias to communicate the current from one turn to the other. The same symmetry exists between the secondary PCB on both sides of the main/primary PCB.

For applications where an additional resonant inductor or soft switching inductor is reguired in series or in parallel with the primary, the additional inductor element can be also constructed in the same multilayer PCB. The inductance created in inner layers of the PCB, rectangular slots in the PCB to accommodate the magnetic core, and two pins for connections. It may be used with either of the previous type of transformer connections, pads or special connectors.

For some other applications wherein the transformer should minimize the noise injection between the primary winding to the secondary winding two open loops may be constructed on the top and the bottom of the multilayer PCB. The open loops are created on the copper top and bottom layer of the main PCB, and is separated from the secondary with a thin insulator sheet. The two open loops communicate through a via through the PCB, which is the common connection of the loops. The common connection of these loops can be further connected to a quiet point in the primary section of the primary such as the DC voltage bus, or the input ground. For isolation purposes the connection between the common connection of the open loops and the quiet point can be made through a capacitor. A capacitor located on one side of the PCB, which will have special soldering pads, will provide separation for the output connector pin.

DESCRIPTION OF THE PREFERRED EMBODIMENTS

Figure 1A:
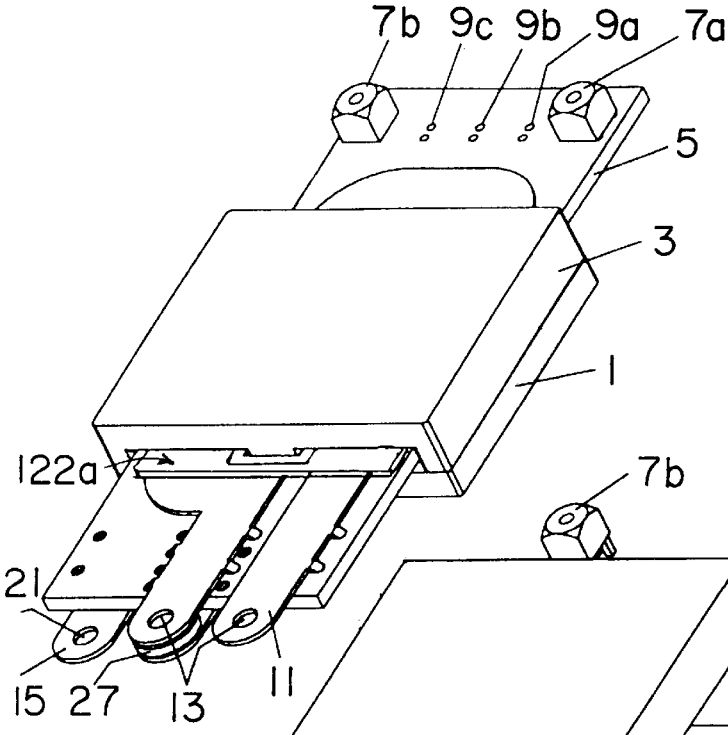
FIGS. 1*a* and 1*b* show perspective views, assembled and exploded, of the main embodiment of the transform
Figure 1B:
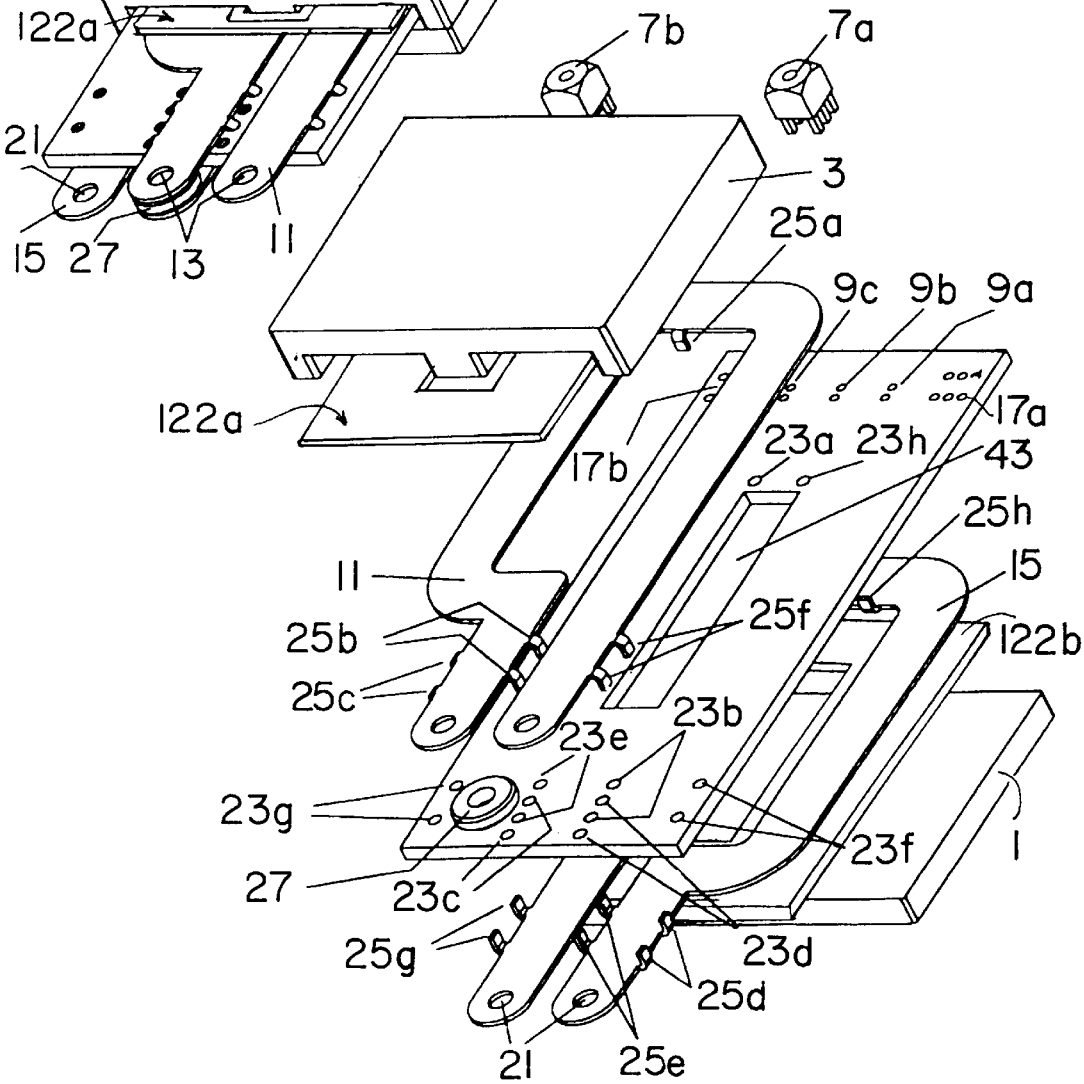

FIGS. 1A and 1B show a 3-dimensional view of the preferred embodiment of the present invention, consisting in a transformer made of one multilayer PCB 5, with internal layers containing the primary windings, two-turn-secondary made of thick copper strips, 11 and 15, one on each side of the PCB 5. The primary uses power contacts 7*a* and 7*b*, which go into the designed metalized holes 17*a* and 17*b*. The primary windings use vias 9*a*, 9*b*, 9*c* in order to connect each layer's winding with another layer's winding.

The secondary strips use bent pins 25*f*, 25*b*, 25*c* and 25*a* respectively 25*g*, 25*e*, 25*d* and 25*h* to mount on the PCB 5, into specially designed holes: 23*f*, 23*b*, 23*c* and 23*a* respectively 23*g*, 23*e*, 23*b* and 23*h*. The pins offer an accurate and rigid positioning of the copper secondary strip on the PCB. The pins and holes close to the center of the board, also have an electrical role, to connect the end of the upper turn 11, to the beginning of the bottom turn 15, of the secondary winding, and offering a middle tap to the same winding. The connection to the secondary is made with direct contacting the secondary ends, using the holes 13 and 21, and middle copper spacer 27 between the upper and lower middle tap. The magnetics use an E-type upper 3 and an I-type lower half 1, which assemble together using the central cut-out 43 in the PCB 5.

To isolate the secondary strips from the magnetic core there are inserted two layers made from an isolated material, first layer 122*a* between magnetic core 3 and copper strip 11 and the second layer 122*b* between magnetic core 1 and copper strip 15.

Figure 2:
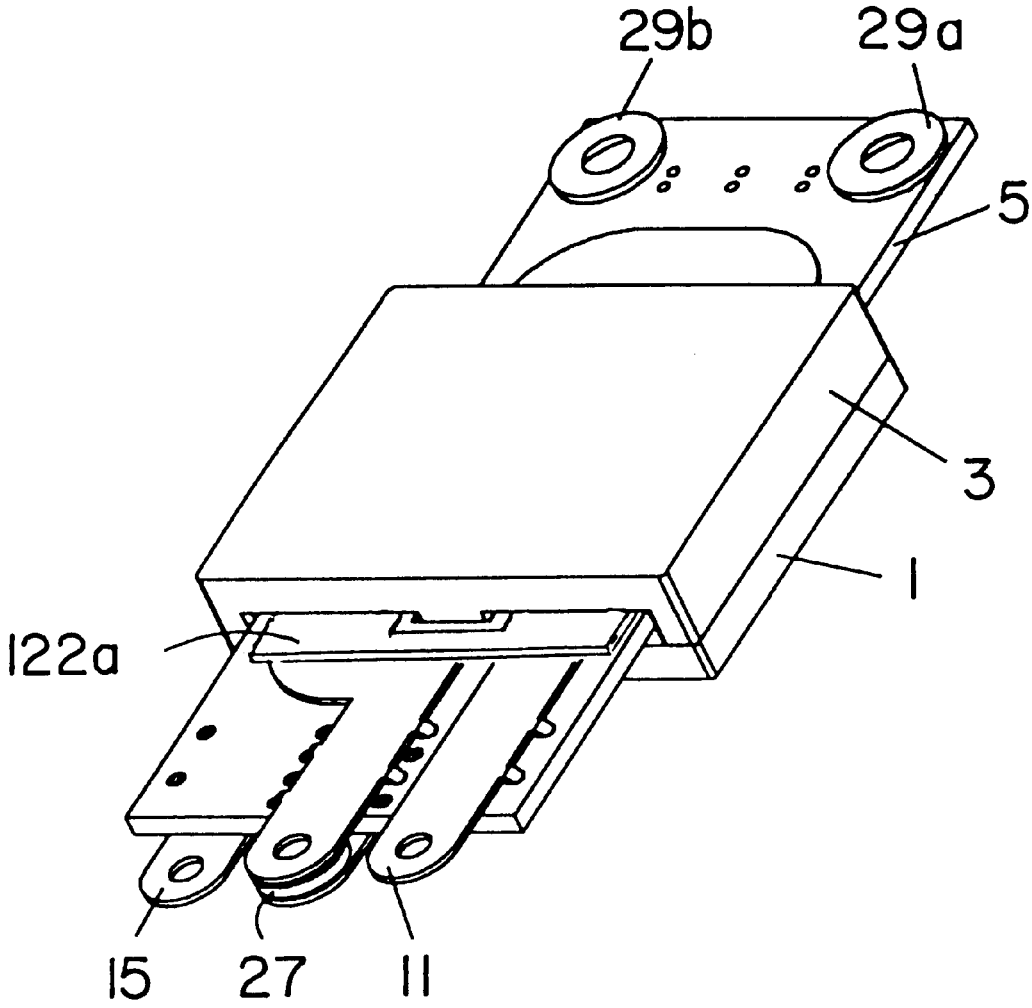
FIG. 2 shows a perspective view of the same transformer, but using contact pads for the primary interconnection.

FIG. 2, show a perspective view of another embodiment of the present invention, which uses contact pads 29*a* and 29*b*, instead of the power connectors 7*a* and 7*b* in FIG. 1.

Figure 3:
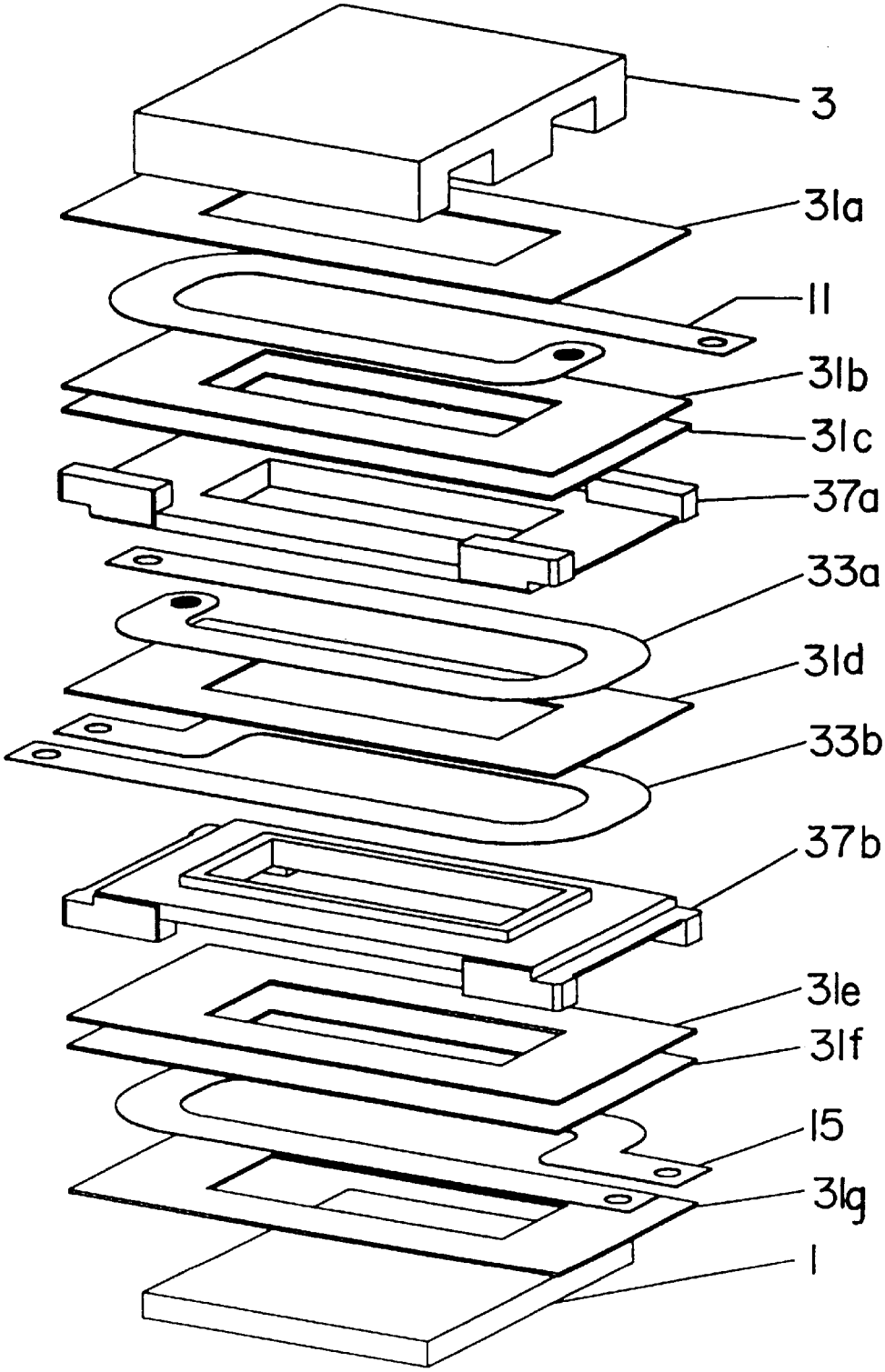
Figure 3 Prior Art
FIG. 3 shows a perspective view of the prior art for a transformer.

FIG. 3 shows the prior art transformer known before the present invention, as a very complex sandwich of core, seven insulator sheets, and discrete copper strips both for the primary and the secondary windings. The sandwich is difficult to prepare and position, the specially shaped spacers require a molding die to manufacture the bobbin, offers limited possibilities in terms of voltage because of the environmental factors related to the primary's winding (humidity, impurities etc.). The top E-type magnetics 3 is on top, then comes an insulator 31*a*, a secondary copper strip 11, two insulator/spacer sheets 31*b* and 31*c*, a specially shaped spacer 37*a*, a primary turn 33*a*, another insulator 31*d*, the other primary turn 33*b*, another specially shaped spacer 37*b*, two insulators 31*e* and 31*f*, the second secondary turn 15, another insulator sheet 31*g*, and finally they I-type magnetics 1.

Figure 4:
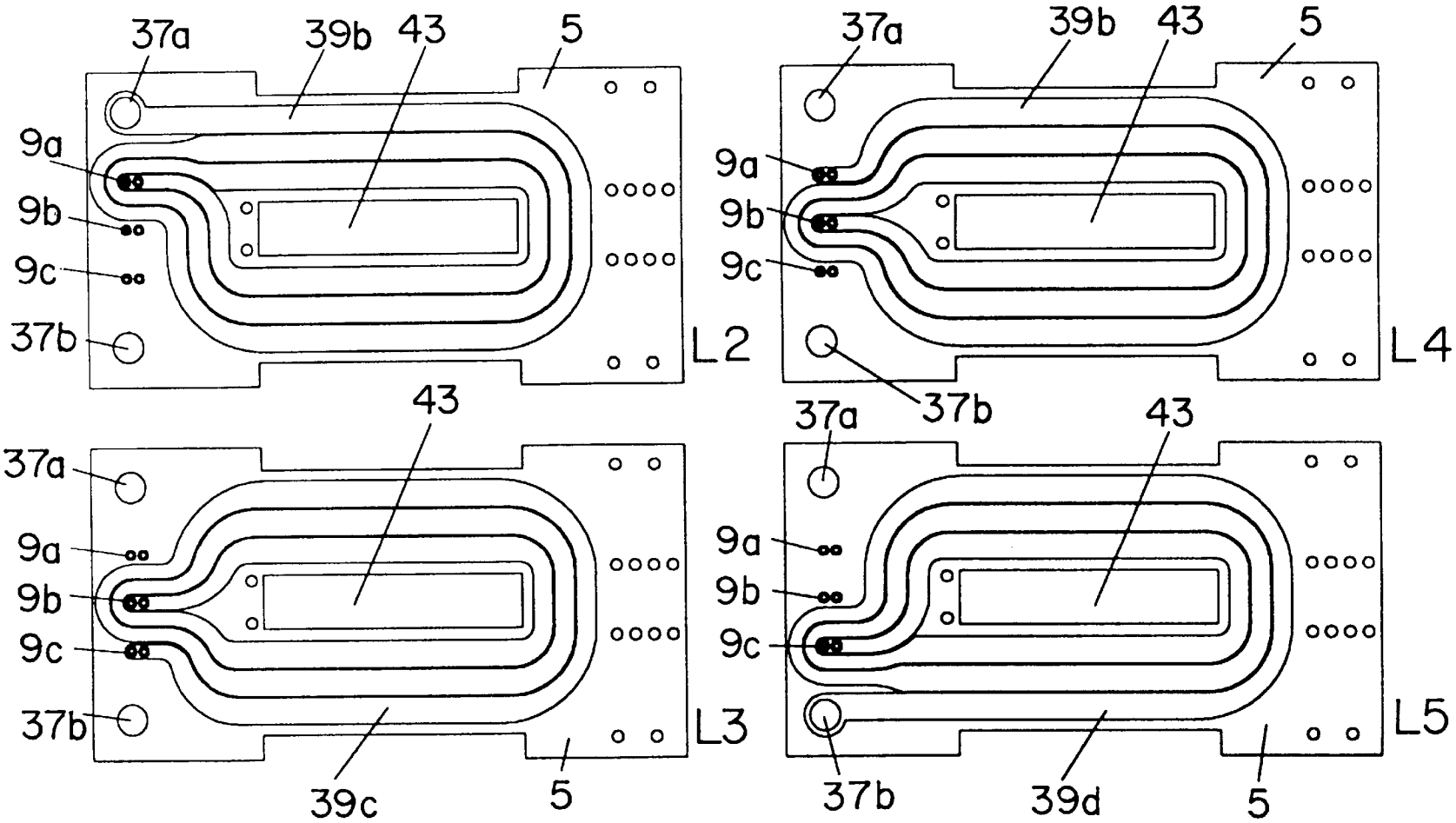
FIG. 4 shows a primary winding solution, for each of the internal 4 layers of the PCB.

FIG. 4 shows a detail of the preferred embodiment of the present invention, the four windings of the primary, each on a separate, interior layer of the PCB. Each layer's winding has two turns, for a total of 8 turns for the primary. The first two turns 39*a*, leave the contact pad 37*a* and go around the cutout in the PCB 43, ending to the first set of vias 9*a*. The next two turns 39*b*, on the next layer, leave the vias 9*a*, go around the slot 43, and end up to the middle set of vias 9*b*. The third two turns 39*c* on the next layer, go the same way between vias 9*b* and vias 9*c*. The last two turns on the fourth layer, 39*d*, extend between the vias 9*c* and the connection pad 37*b*.

Figure 5:
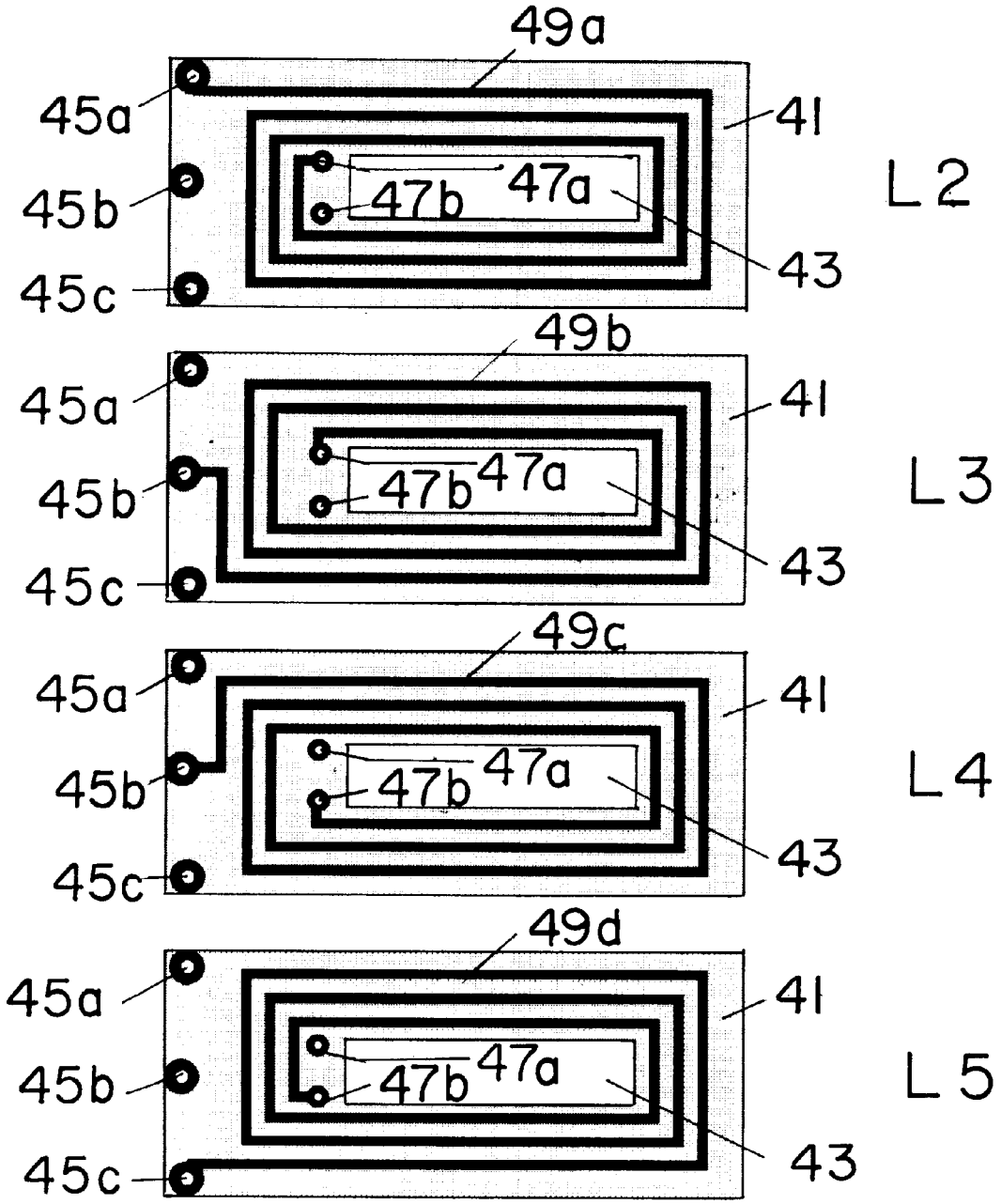
FIG. 5 shows another solution for the primary windings, for each internal layer.

FIG. 5 shows another design for the primary winding of the present invention, using a different location for the vias. Instead of them being aligned, vias 47*a* and 47*b* are positioned to the right, next to the cutout, via 45*b* being close to the edge of the PCB, in the center of side. In this case there will be a insulated layer on top, layer 1 and the insulated layer on the bottom, layer 6 shall cover all the via and comply with the safety agencies foe voltage breakdown.

Figure 6A:
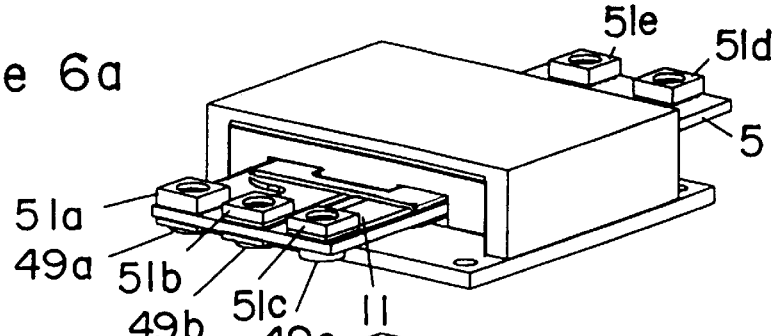
FIG. 6*a* shows another perspective view of the embodiment of the present invention, using power connectors for the primary and secondary, and a mechanical device for both thermal dissipation and mechanical attachment purposes.
Figure 6B:
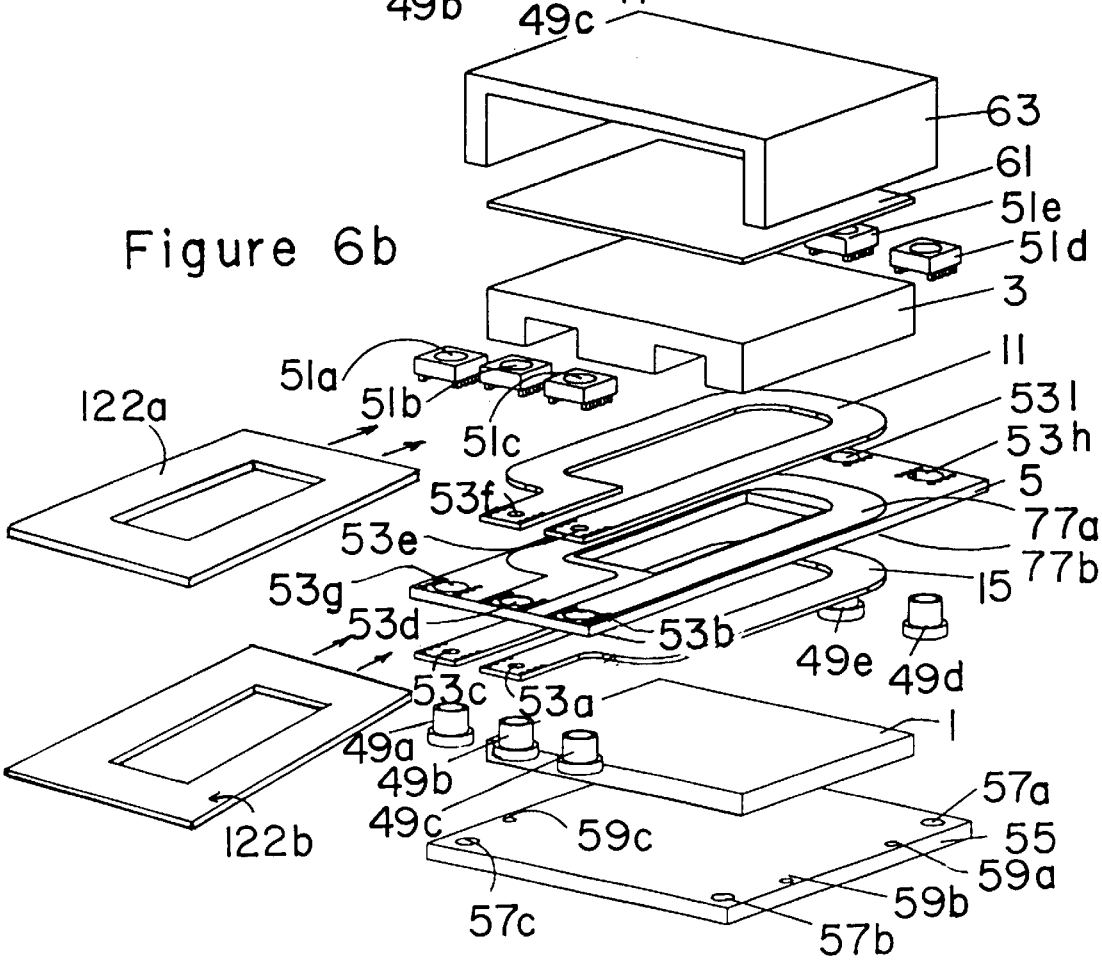
FIG. 6*b* shows the exploded view of the embodiment depicted in FIG. 6*a*.

FIG. 6 shows another embodiment of the present invention in an exploded and an assembled image, where both the primary and the secondary are contacted with power connectors, 51*d*, 51*e*, 49*d*, 49*e*, respectively 51*a*, 51*b*, 51*c*, 49*a*, 49*b*, 49*c*. As a supplementary option the assembly also has a U-shaped aluminum part 63, which covers the E-type magnetics 3, through a compressible insulator pad 61. The U-shaped part is attached to an aluminum base plate 55, using four through holes 59*b*, 59*a*, 59*c*, 59*d* (not seen in the picture), and threaded holes in the side walls of the U-shaped part. Both the U-shaped part 63 and the base-plate 55, function both as thermal dissipators and mechanical attachment parts, to mount the sub-assembly to other parts of the equipment, or to a larger heatsink, according to the requirements of the specific application. This mounting may be done using the holes 57*b*, 57*a*, 57*c*, 57*d* (not seen in the picture). In some applications an additional compressible insulator pad 61 may be necessary in between the magnetic core 1, and the base-plate 55. Two insulator pads 122*a* and 122*b* are placed between copper strip 11 and the magnetic core 3 and respectively between copper strip 15 and magnetic core 1.

Figure 7:
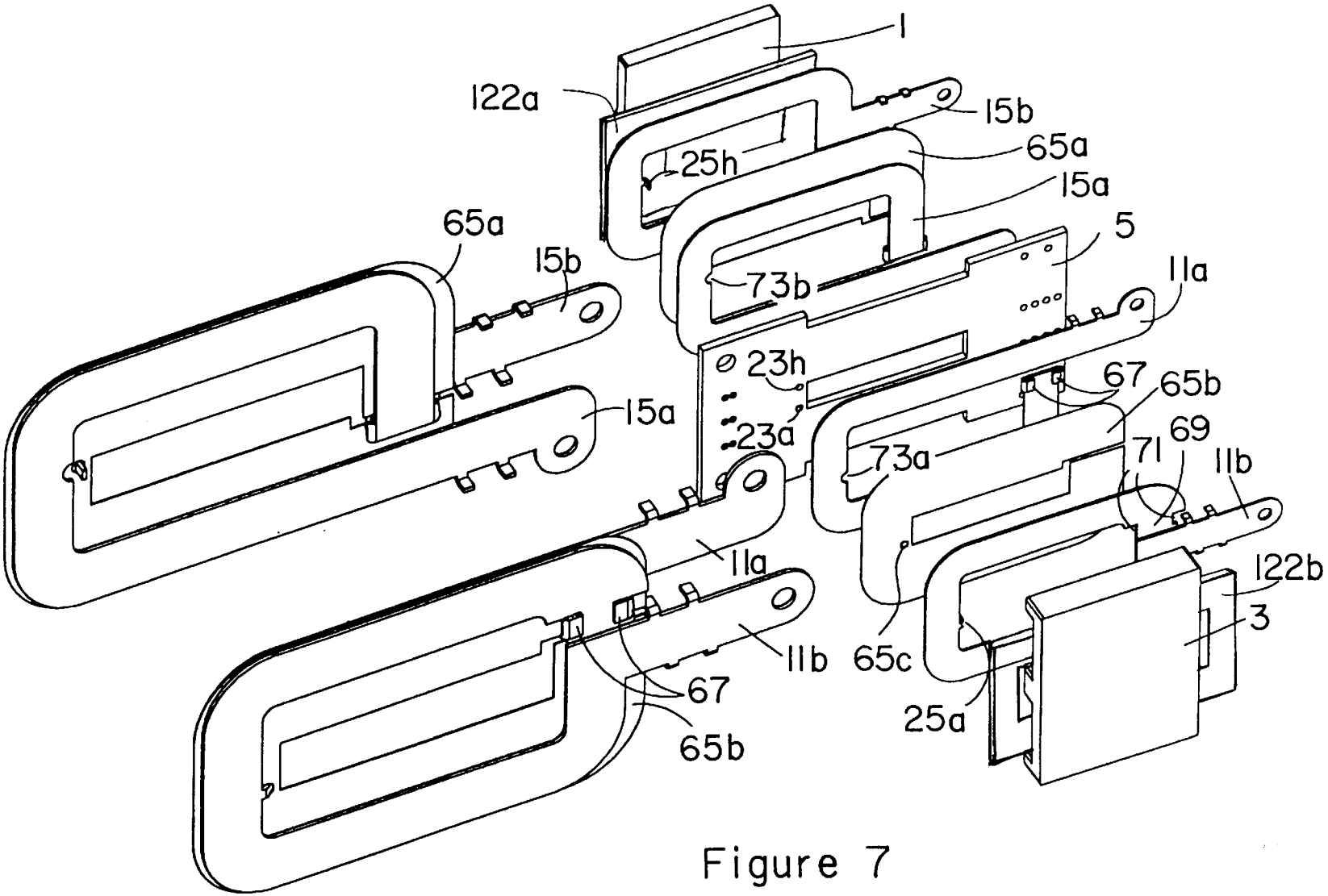
FIG. 7 is another embodiment of the present invention, where the secondary has 4 turns, symmetrical 2 by 2, made out of copper strips, each pair of turns using an attachment solution using specially shaped, bent fins, into designed slots, and soldering over. An insulator insures electrical separation of the turns.

FIG. 7 presents another embodiment of the present invention, with four turns in the secondary winding, two symmetrical turns on each side of the PCB. The two turns on one side 11*b* and 11*a*, are separated by an insulator sheet 65*b*, except for the area where they meet, clamping together using the bent fins 67 of turns 11*a*, and the slots 71 designed to receive the fins in the contact area 69. This area will also be soldered for better, reliable electrical contact. This two-turn-subassembly is also symmetrical; the one on one side being identical to the one on the other side only flipped 180 degrees. The insulator sheet 65*b* has a small hole 65*c*, to allow for the pin 25*a* of the first secondary loop to go trough. Also the second loop of the secondary 11*a* has a small notch 73*a*, to the same purpose, not to shorten the first two turns of the secondary winding. The pin 25*a* will have to go into the hole 23*a* of the PCB 5, where it will be soldered for fastening and securing the upper secondary to the PCB. The same goes for the other side, with pin 25*h*, notch 73*b* hole 65*d* (not seen) and hole 23*h*. Two additional insulator sheets 122*a* and 122*b* are placed in between copper strip 15*b* and magnetic core 1, and respectively between copper strip 11*b* and magnetic core 3.

Figure 8:
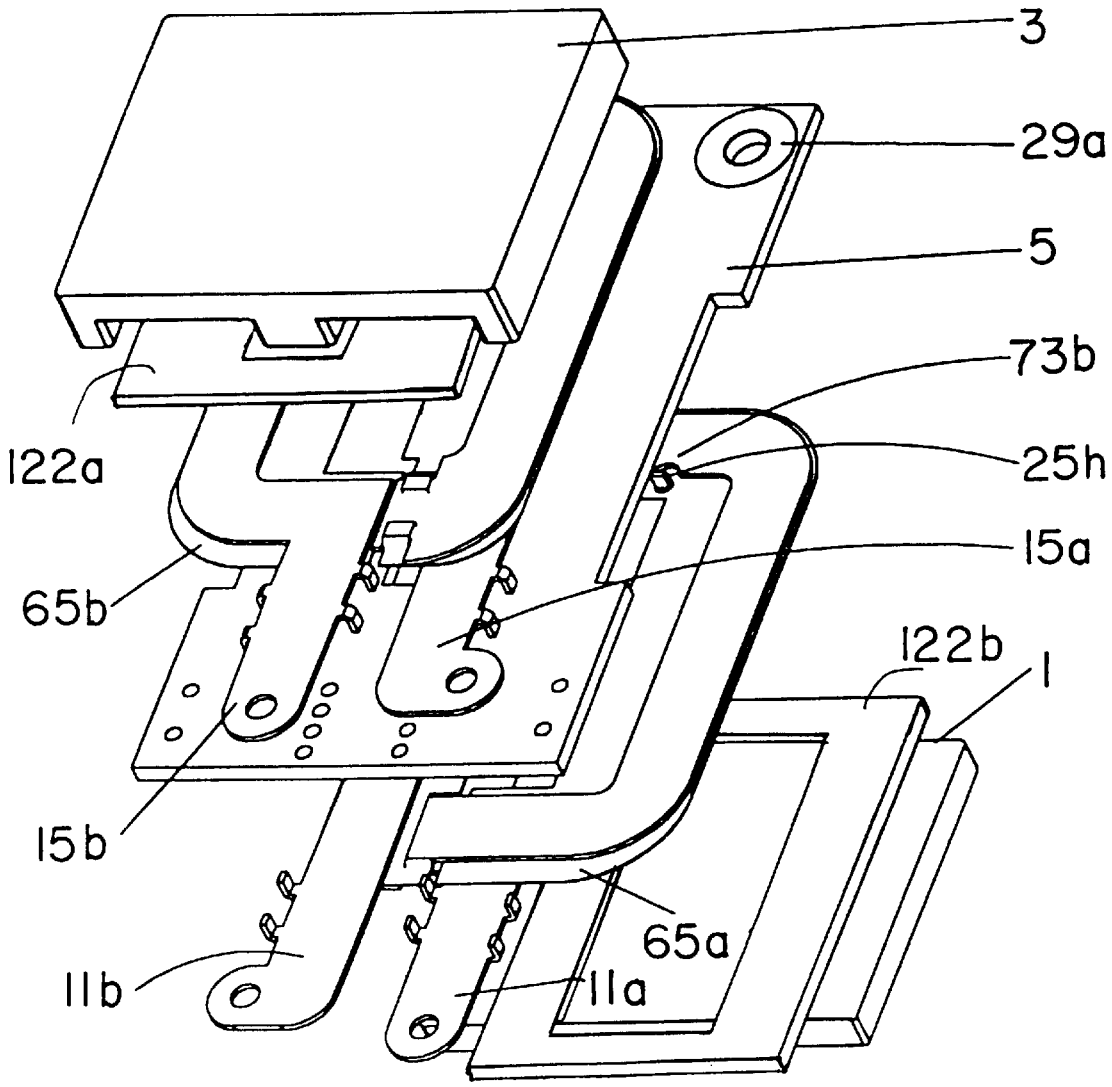
FIG. 8 shows the embodiment depicted in FIG. 7, from another angle.

FIG. 8 shows the same embodiment, from another angle.

Figures 9A, 9B, 9C:
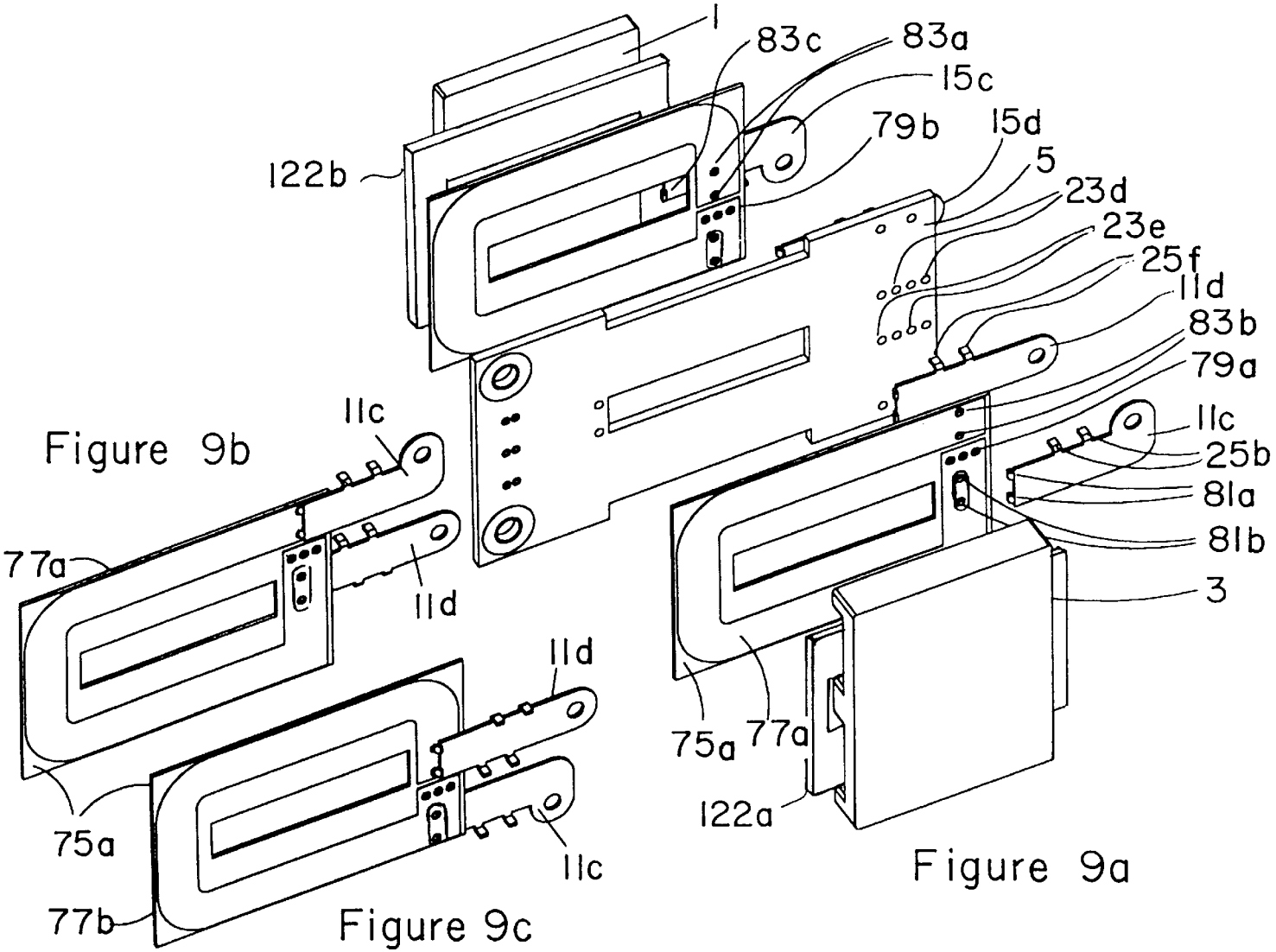
FIGS. 9*a*, 9*b* and 9*c* show another embodiment of the present invention, with the secondary built on PCB sheets, each turn as a copper layer on each side of the secondary PCB. The communication is made by vias. The connection is obtained with attached, thick copper connectors, shaped as for the main embodiment, but mounted each on opposed sides of the secondary PCB. The symmetry is also present between the upper and lower 2 turns on each side of the main PCB.

FIGS. 9*a*, 9*b* and 9*c* show another embodiment of the present invention, with the secondary built on thin PCB sheets, each turn as a copper layer on each side of the secondary PCB. Each additional secondary PCB 75*a*, is a double sided PCB with a secondary trace on each side, 77*a* and 77*b*, making together two turns. The communication is done with the vias 79*a*. The PCB plays the role of the insulator. The connection are 11*d* and 11*c*. They are mounted on the corresponding sides of the PCB, so as to be connected at the ends of the two-turn-loop. There is also a perfect symmetry between the two turns sub-assembly on one side of the main PCB and the other one, on the other side. Each of them can be mounted on either side. The same construction methodology can apply in the event wherein more than a full turn is implemented on each PCB. Each secondary PCB can contain more then one turn, by employing a multilayer PCB. Two additional insulator sheets 122*a* and 122*b* are placed in between additional secondary PCB and the magnetic cores.

Figure 10:
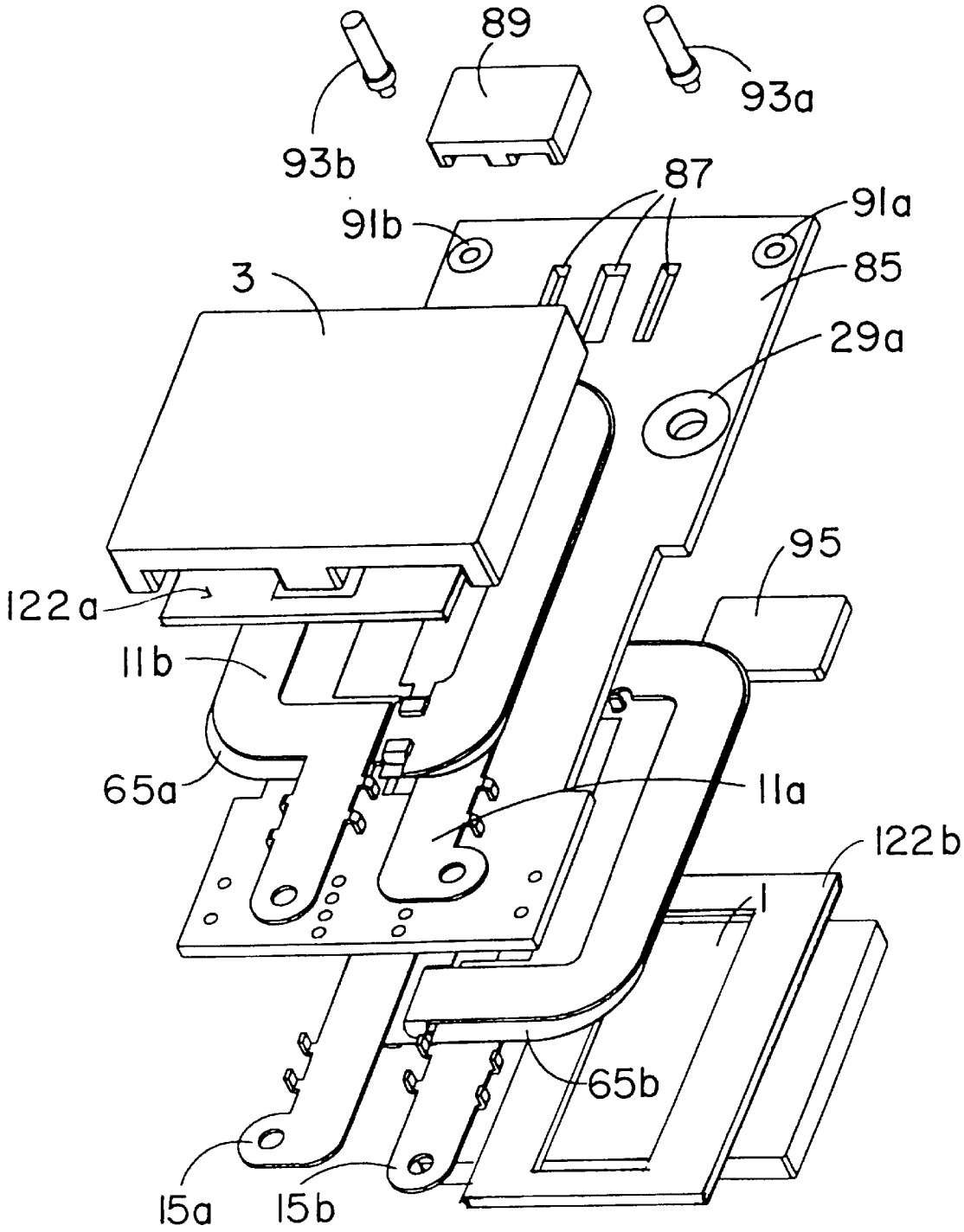
FIG. 10 shows another embodiment of the present invention, using the layout presented in FIG. 8, but with an additional resonant inductor. The resonant inductor has specific cutouts in the PCB to accommodate the magnetic and padded holes to receive the designed contact pins.

FIG. 10 shows another embodiment of the present invention, using the layout presented in FIG. 8, but with an additional resonant inductor composed by magnetic cores 89 and 95, and winding inside of PCB 85. The resonant inductor has specific cutouts in the PCB, 87 to accommodate the magnetics, 89 and 95, and padded holes 91*a* and 91*b*, to receive the designed contact pins 93*a* and 93*b*.

Figures 11A, 11B:
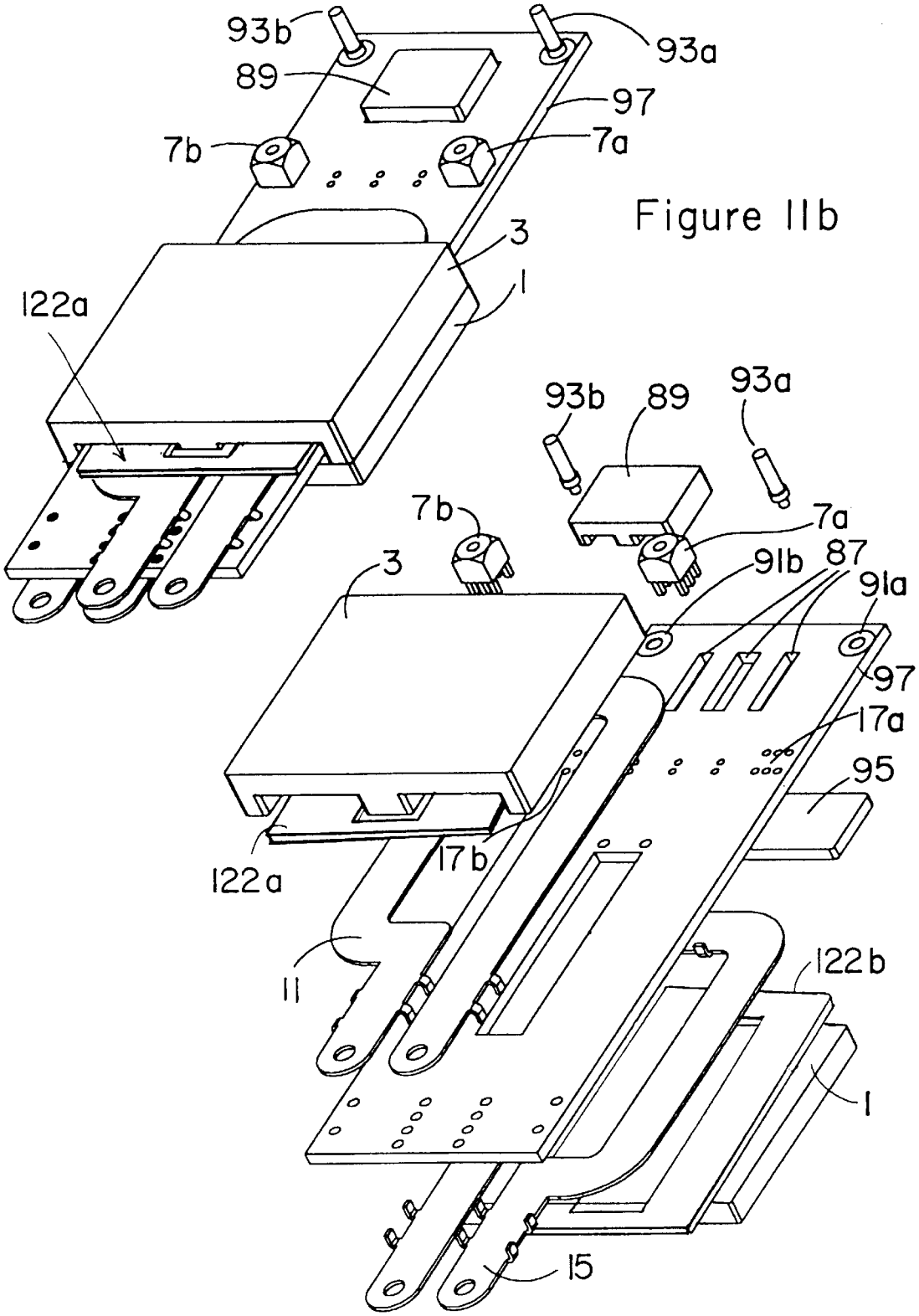
FIG. 11*a* shows another embodiment of the present invention, in exploded view, using the layout presented in FIG. 10, but using designed, specific power connectors for the primary, and direct contact for the secondary.
FIG. 11*b* shows the embodiment of FIG. 11*a* in a mounted view.

FIGS. 11A and 11B shows another embodiment of the present invention, using the layout presented in FIG. 10, but using designed, specific power connectors, 7*a* and 7*b*, for the primary, and direct contact for the secondary.

Figure 12B:
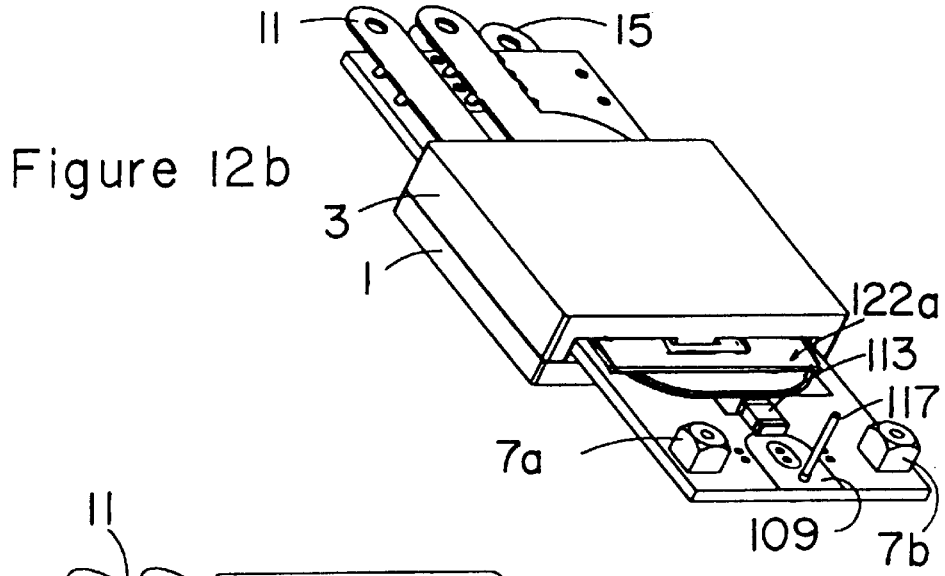
FIG. 12*b* shows the embodiment of FIG. 12*a* in a mounted view.
Figure 12A:
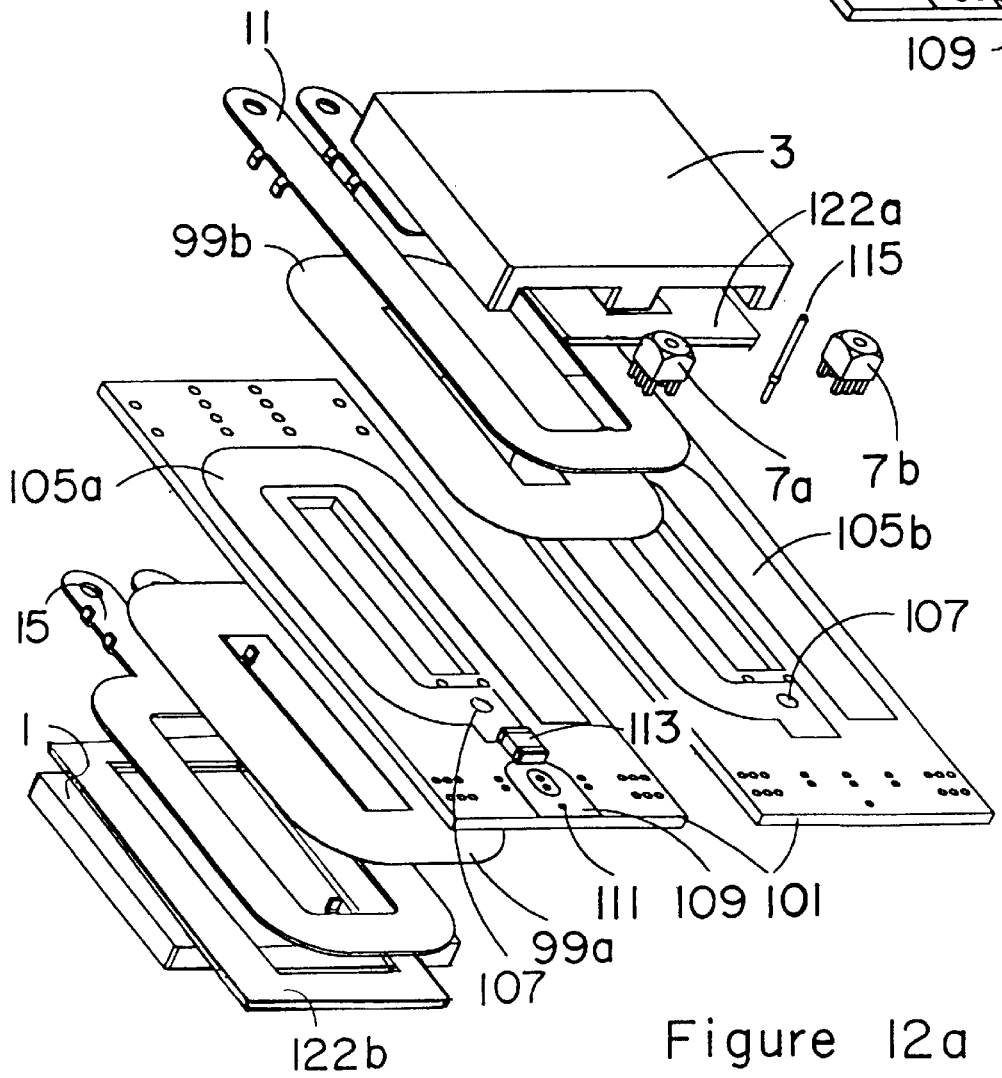
FIG. 12*a* shows another embodiment of the present invention wherein open loop traces are used to reduce the noise injection between primary and secondary windings.

FIGS. 12A and 12B shows another embodiment of the present invention wherein two open turns 105*a* and 105*b* with a common connection 107 are implemented on the multilayer PCB 101. The common connection implemented by a via coated with copper to create an electrical contact between 105*a* and 105*b* is further connected to a isolation capacitor 113 to a pad 109. A pin 117 is connected to the pad 1098 through hole 111. The pin 117 can be further connected to a quiet potential. A quiet potential can be the input DC source or the input GND of the power system wherein the transformer structure is employed. The role of the open loop 105*b* and 105*b* is to create a shield between the primary and secondary. The voltage created by the magnetic filed in the transformer will have similar amplitude but opposite polarities on the 105*a* and 105*b*. As a result the voltage induced by 105*a* and 105*b* in the secondary windings 11 and 15 will cancel each other. The capacitor 113 is there to ensure voltage insulation in compliance with the safety agencies requirements. In some applications several capacitors in series may be required. The use of the open turns 105*a* and 105*b* with a common connection to a quiet potential creates a noise cancellation circuit designed to reduce the noise transfer between the primary and secondary winding of the transformer.

Figure 13:
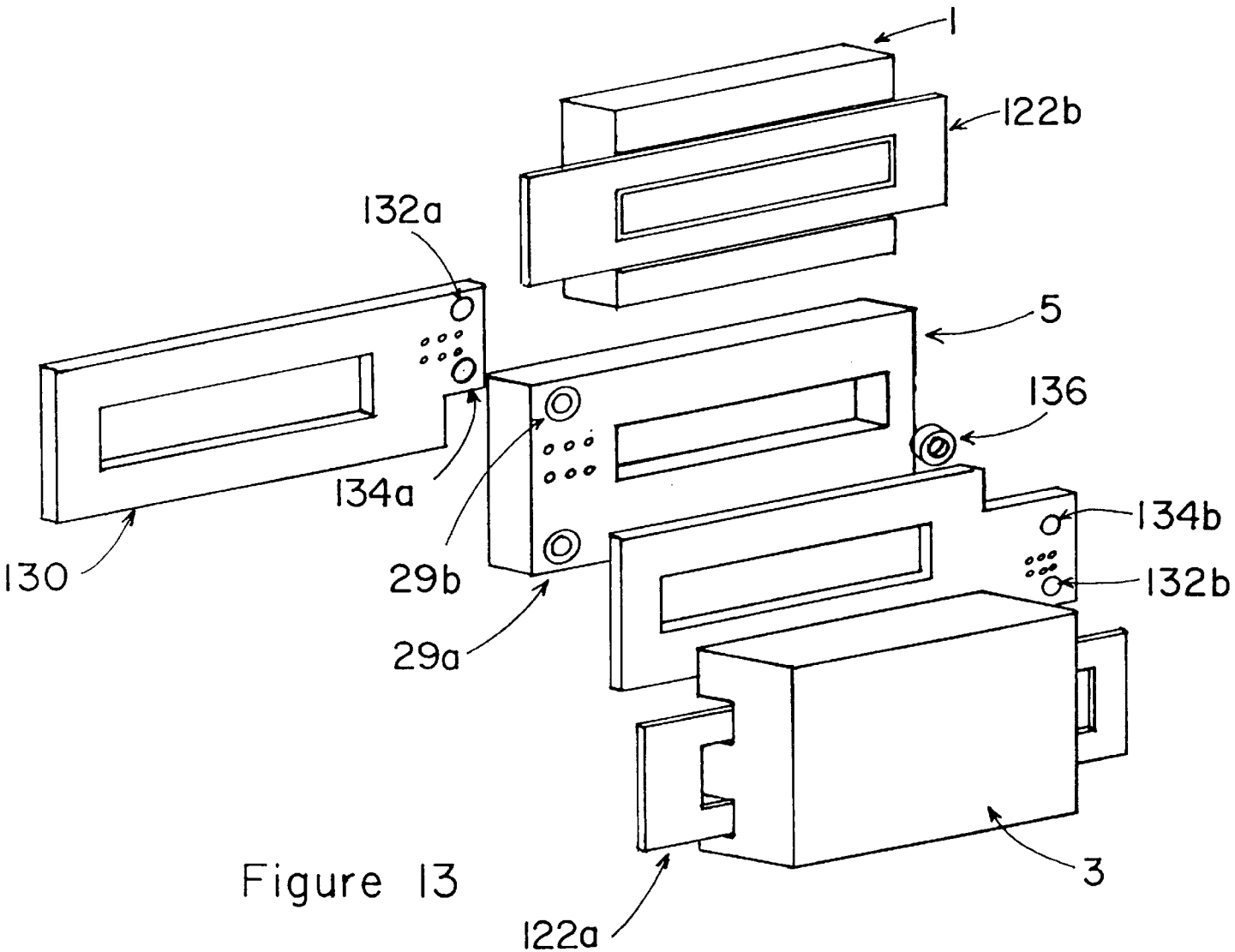
FIG. 13 shows an embodiment of the invention wherein the secondary winding are embedded in two multilayer PCB and the interconnection between the secondary winding is done via electrically conductive spacer.

FIG. 13 shows another embodiment of the present invention wherein the secondary winding are implemented into the layers of the multilayer PCB, 130. There are two identical secondary multiplier PCBs. The interconnection in between is performed by using a copper spacer 136. In this embodiment the secondary winding can have a larger number of turns, easily implemented in the multilayer PCB 130. The primary PCB 5 gets sandwiched in between two secondary PCB, 130, one flipped to each other in a such way that the middle metalized hole 134*a* aligns with 134*b*, departed by the spacer 136. Two additional isolated sheets 122*a* and 122*b* will be placed in between the secondary PCB and the magnetic core for insulation and also to apply a mechanical pressure of the ensemble.

It is obvious for those skilled in the art that the secondary section and primary section can be interchanged function of the operating conditions. It is also obvious that the center tap concept for the secondary winding can be replaced to one turn secondary using the same construction technique. While several illustrative embodiments of the invention have been shown and described, numerous variation and alternate embodiments will occur to those skilled in the art, without departing from the spirit and scope of the invention. Accordingly, it is not intended that the present invention not be limited solely to the specifically described illustrative embodiments. Various modifications are contemplated and can be made without departing from the spirit and scope of the invention as defined by the appended claims.

What is claimed is:

1. A transformer, comprising:

a) a multilayer board, having multiple layers of dielectric sheets;

b) a first transformer core extending through said layers of dielectric sheets;

c) a first set of electrically conductive buried windings, each of said buried windings encircling said first transformer core, and, each of said buried windings contained between two adjoining layers of said dielectric sheets;

d) at least one copper strip encircling the said magnetic core secured to a first surface of said multilayer board over said buried winding; wherein said copper strip has bent pins for accurate positioning on said multilayer board.

2. A transformer according to claim 1, wherein all of said buried windings are electrically connected to each other.

3. A transformer according to claim 1, wherein said buried windings are connected to a power connector.

4. A transformer according to claim 1, wherein said transformer core is placed in contact to a thermally conductive U-shaped top and a thermally conductive base plate via a compressible thermally conductive pad; said U-shaped top and said thermally conductive plate assembled together by mounting screws; said thermally conductive plate offering holes for attachment to an external heat-sink.

5. A transformer according to claim 1, wherein said copper strip encircles the said transformer core more than once and isolation sheets are placed between each turn of said copper strip.

6. A transformer according to claim 1, wherein on the both surfaces of said multilayer board covered by said dielectric sheets, there are two one open turn windings having a first and a second end; said open turn windings electrically connected to said first end; from said first end the two open turn winding encircle said transformer core in opposite directions; a capacitor connected to the first end and said open turn windings to a connector pad.

7. The transformer according to claim 1, wherein said first set of buried windings are each encapsulated in epoxy.

8. A magnetic structure, comprising:

a) a multilayer board, having multiple layers of dielectric sheets;

b) a first transformer core extending through said layers of dielectric sheets;

c) a first set of electrically conductive buried windings, each of said buried windings encircling said first transformer core, and, each of said buried windings contained between two adjoining layers of said dielectric sheets;

d) at least one copper strip encircling the said magnetic core secured to a first surface of said multilayer board over said buried winding; wherein said copper strip has bent pins for accurate positioning on said multilayer board;

e) a second transformer core extending through said layers of dielectric sheets;

f) a second set of electrically conductive buried winding, each of said buried windings encircling said second transformer core, and, each of said buried windings contained between two adjoining layers of said dielectric sheets.

9. A transformer according to claim 8 wherein all of said buried windings are electrically connected to each other.

10. A transformer according to claim 8 wherein said buried windings are connected to a power connector.

11. A transformer according to claim 8 wherein said first transformer core is placed in contact to a thermally conductive U-shaped top and a thermally conductive base plate via a compressible thermally conductive pad; said U-shaped top and said thermally conductive plate assemble together by mounting screws; said thermally conductive plate offering holes for attachment to an external heat-sink.

12. A transformer according to claim 8 wherein said copper strip encircles the said first transformer core more than once and isolation sheets are placed between each turn of said copper strip.

13. A transformer according to claim 8 wherein said first set of electrically conductive buried windings and said second set of electrically conductive buried winding, are electrically connected to each other.

14. A transformer according to claim 8 wherein on the both surfaces of said multilayer board covered by said dielectric sheets, there are two one open turn windings having a first and a second end; said open turn windings electrically connected to said first end; from said first end the two open turn winding encircle said first transformer core in opposite directions; a capacitor connected to the first end of said open turn winding to a connector pad.

15. The transformer according to claim 8 wherein said first set of buried windings are each encapsulated in epoxy.

16. The transformer according to claim 8 wherein said second set of buried windings are each encapsulated in epoxy.

17. The transformer according to claim 8 wherein said first and said second set of buried windings are each encapsulated in epoxy.

18. A magnetic structure, comprising:

a) a first multilayer board, having multiple layers of dielectric sheets;

b) at least a second multilayer board, having multiple layers of dielectric sheets;

c) a first transformer core extending through said layers of dielectric sheets of said first multilayers board and said second multilayer board;

d) a first set of electrically conductive buried windings, each of said buried windings of said first multilayer board encircling said first transformer core, and, each of said buried windings contained between two adjoining layers of said dielectric sheets;

e) a second set of electrically conductive buried windings, each of said buried windings of said first multilayer board encircling said first transformer core, and, each of said buried windings contained between two adjoining layers of said dielectric sheets;

f) a least a copper strip encircling said magnetic core secured to first surface of said second multilayer board over said buried winding; wherein said copper strip has a first set of bent pins to accurate positioning on said second multilayer board and a second set of bent pins to accurate positioning on said first multilayer board.

19. A transformer according to claim 18 wherein said transformer core is placed in contact to a thermally conductive U-shaped top and a thermally conductive base plate via a compressible thermally conductive pad; said U-shaped top and said thermally conductive plate assembled together by mounting screws; said thermally conductive plate offering holes for attachment to an external heat-sink.

20. A transformer according to claim 18 wherein on the both surfaces of said first multilayer board covered by said dielectric sheets, there are two one open turn windings having a first and a second end; said open turn windings electrically connected to said first end; from said first end the two open turn winding encircle said transformer core in onsite directions; a capacitor connected to the first end of said open turn winding to a connector pad.

21. The transformer according to claim 18 wherein said first set of buried windings are each encapsulated in epoxy.

22. The transformer according to claim 18 wherein said second set of buried windings are each encapsulated in epoxy.

23. The transformer according to claim 18 wherein said first set of buried windings and second set of buried windings are each encapsulated in epoxy.

* * * * *